US006612529B2

(12) United States Patent
Snyder

(10) Patent No.: US 6,612,529 B2
(45) Date of Patent: Sep. 2, 2003

(54) DUCT HANGER

(75) Inventor: Darryl L. Snyder, Canton, OH (US)

(73) Assignee: Snyder National Corporation, Canton, OH (US)

( * ) Notice: Subject to any disclaimer, the term of this patent is extended or adjusted under 35 U.S.C. 154(b) by 0 days.

(21) Appl. No.: 10/076,808

(22) Filed: Feb. 14, 2002

(65) Prior Publication Data

US 2002/0113184 A1 Aug. 22, 2002

Related U.S. Application Data

(60) Provisional application No. 60/270,042, filed on Feb. 20, 2001.

(51) Int. Cl.[7] ..... A47F 5/00

(52) U.S. Cl. ..... 248/301; 24/347; 248/216.1

(58) Field of Search ..... 248/216.1, 218.2, 248/216.4, 218.3, 323, 317, 339, 301, 239, 240, 546, 300, 214, 215; 411/466; 403/188; 24/347; D8/373, 304, 305

(56) References Cited

U.S. PATENT DOCUMENTS

| | | | | | |
|---|---|---|---|---|---|
| 2,264,666 | A | | 12/1941 | Hexdall | |
| 2,271,784 | A | * | 2/1942 | Tritt | 211/123 |
| 2,563,242 | A | | 8/1951 | Hexdall | |
| 3,001,752 | A | * | 9/1961 | Loy | 182/87 |
| 3,458,166 | A | | 7/1969 | Lanz | |
| 3,749,341 | A | * | 7/1973 | Swessel, Jr. | 248/327 |
| 4,062,087 | A | * | 12/1977 | Lingle | 24/347 |
| 4,619,430 | A | * | 10/1986 | Hogg | 248/216.1 |
| 4,935,998 | A | * | 6/1990 | Frazier et al. | 24/347 |
| 5,509,632 | A | * | 4/1996 | Mesna et al. | 248/301 |
| 6,202,969 | B1 | * | 3/2001 | Orr | 248/301 |
| D462,892 | S | * | 9/2002 | Snyder | D8/373 |
| D463,255 | S | * | 9/2002 | Snyder | D8/373 |

FOREIGN PATENT DOCUMENTS

| | | |
|---|---|---|
| CA | 880170 | 9/1971 |

* cited by examiner

*Primary Examiner*—Ramon O. Ramirez
*Assistant Examiner*—Tan Le
(74) *Attorney, Agent, or Firm*—Sand & Sebolt

(57) ABSTRACT

A duct hanger used to connect ducts to supports includes a main shaft with a hook disposed at one end of the shaft and a loop connected to the other end of the shaft. The loop allows the hangers to be disposed back-to-back. The loop also allows the hanger to pivot with respect to the support.

15 Claims, 8 Drawing Sheets

DUCT HANGER

CROSS-REFERENCE TO RELATED APPLICATIONS

This application claims priority from U.S. Provisional Patent Application serial No. 60/270,042 filed Feb. 20, 2001; the disclosures of which are incorporated herein by reference.

BACKGROUND OF THE INVENTION

1. Technical Field

The present invention generally relates to hangers and, more particularly, to hangers used to suspend sheet metal ducts from wooden beams or other support members. Specifically, the invention relates to a hanger that may be used in a left hand or right hand configuration and may be used back-to-back.

2. Background Information

Various types of duct hangers are known in the art. Each type of duct hanger presents at least one disadvantage to the person installing and using the duct hanger. Some duct hangers can only be used on the left or right hand side of the duct requiring the user to segregate the hangers. Other hangers include projections that prevent them from hanging side-by-side ducts because the hanger would interfere with the adjacent hanger. Still other duct hangers cannot be installed between existing ducts because of their configuration. The art desires a duct hanger that overcomes these drawbacks and provides a secure mounting arrangement for a duct.

SUMMARY OF THE INVENTION

The invention provides a hanger that is used to connect a duct to a support. The hanger includes a main shaft that has a hook disposed at one end of the shaft. The hook is adapted to engage the duct to support the duct. A loop is disposed at the other end of the shaft. The loop is adapted to receive a connector that connects the hanger to the support.

In one embodiment, the hook projects substantially perpendicular from the shaft such that it engages the bottom of the duct. Other embodiments include a pointed hook adapted to puncture the duct.

The invention also provides a hanger having a flat rear surface so that the hangers may be positioned in a back-to-back relationship.

BRIEF DESCRIPTION OF THE DRAWINGS

Similar numbers refer to similar elements throughout the specification.

DETAILED DESCRIPTION OF THE DRAWINGS

Figure 1:
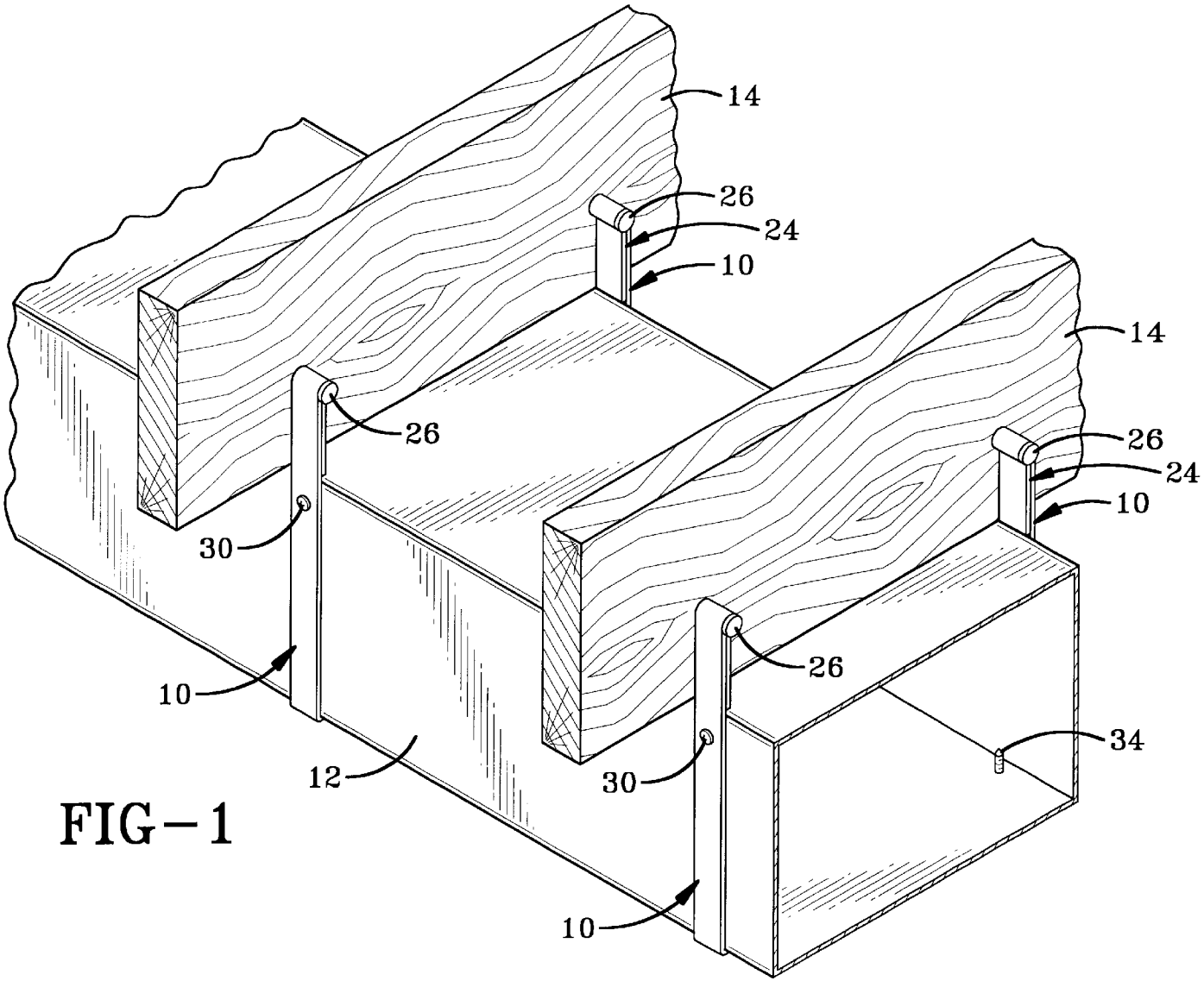
FIG. 1 is a perspective view of a duct being hung with four of the duct hangers of the present invention.
Figure 2:
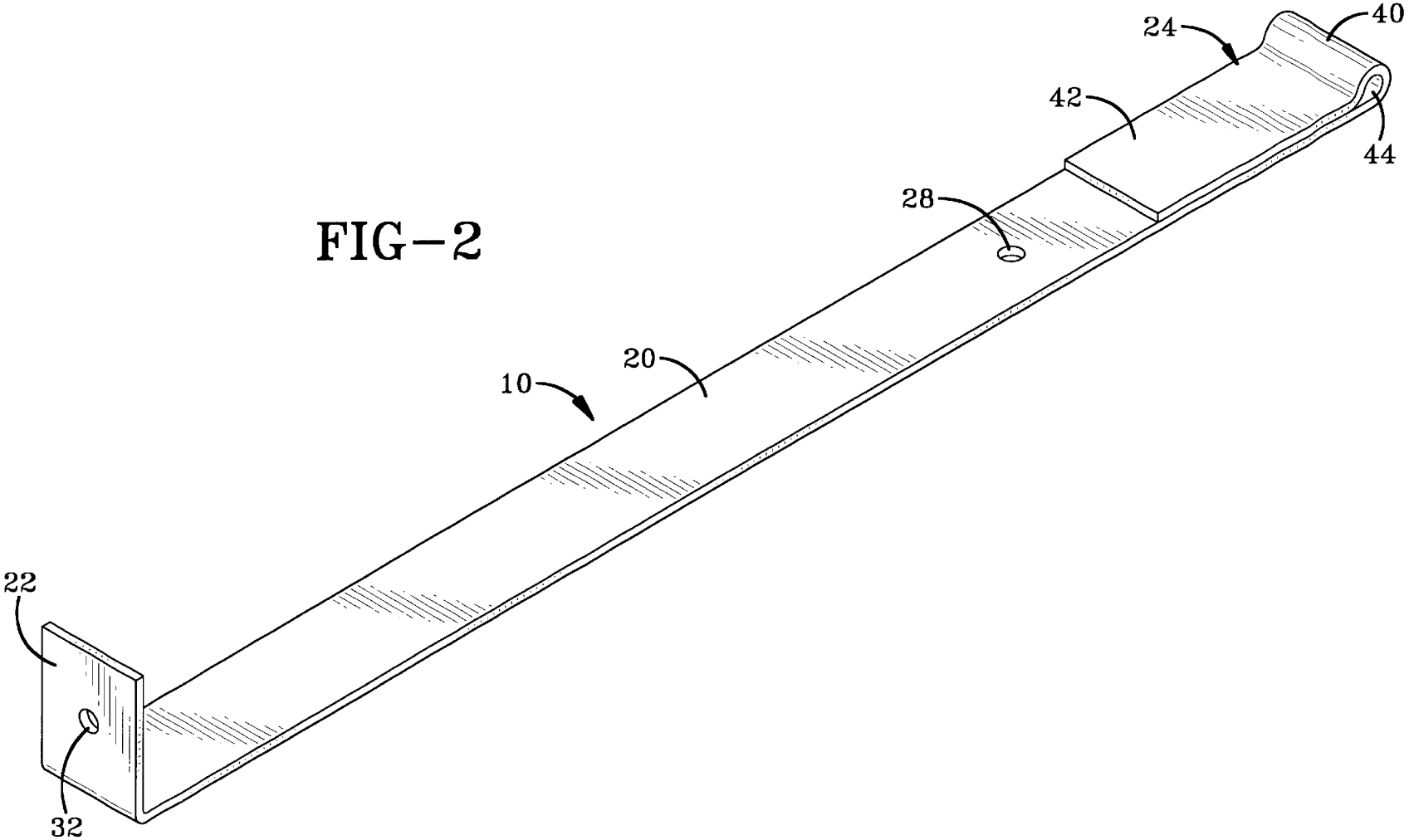
FIG. 2 is a perspective view of a first embodiment of the duct hanger of the present invention.

The first embodiment of the duct hanger is indicated generally by the numeral 10 in FIGS. 1–7. Duct hangers 10 are used to hang a duct 12 from supports 14 as depicted in FIG. 1. Duct 12 is typically an air duct used in heating, ventilation, and air conditioning applications. Supports 14 are typically wooden floor joists.

Figure 6:
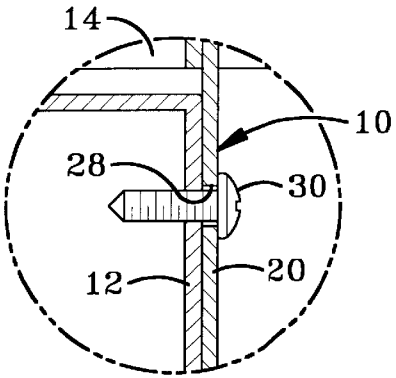
FIG. 6 is an enlarged sectional view of the encircled portion of FIG. 5.
Figure 7:
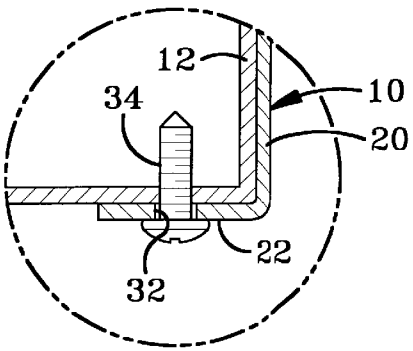
FIG. 7 is an enlarged sectional view of the encircled portion of FIG. 5.
Figure 5:
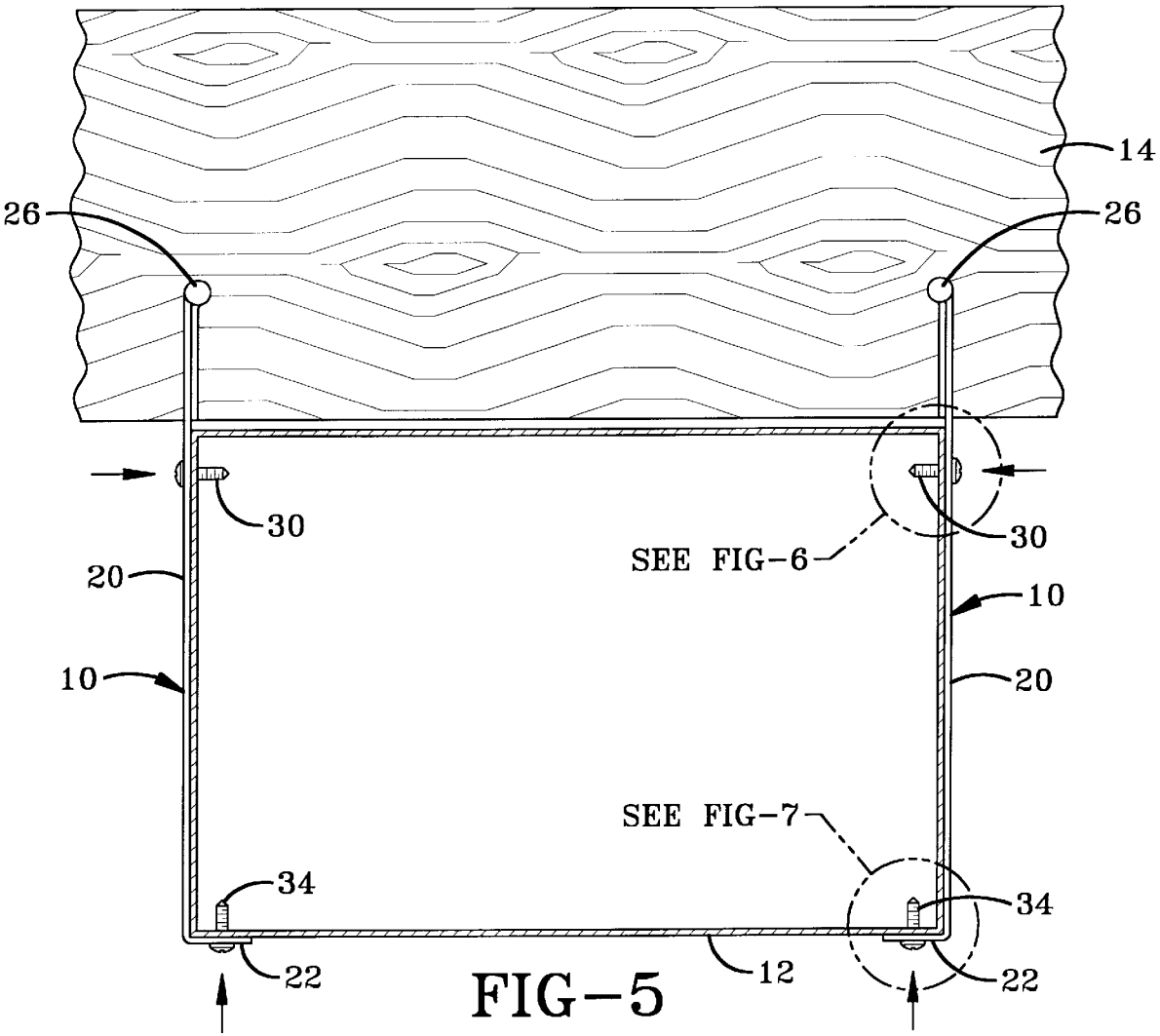
FIG. 5 is a front elevation view showing the duct being connected to the duct hangers.
Figure 8:
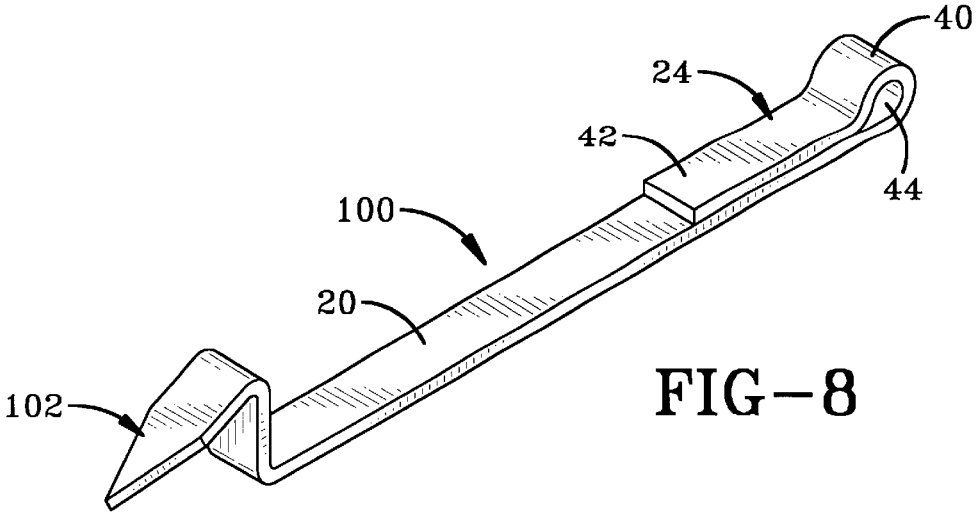
FIG. 8 is a perspective view of a second embodiment of the duct hanger of the present invention.
Figure 12:
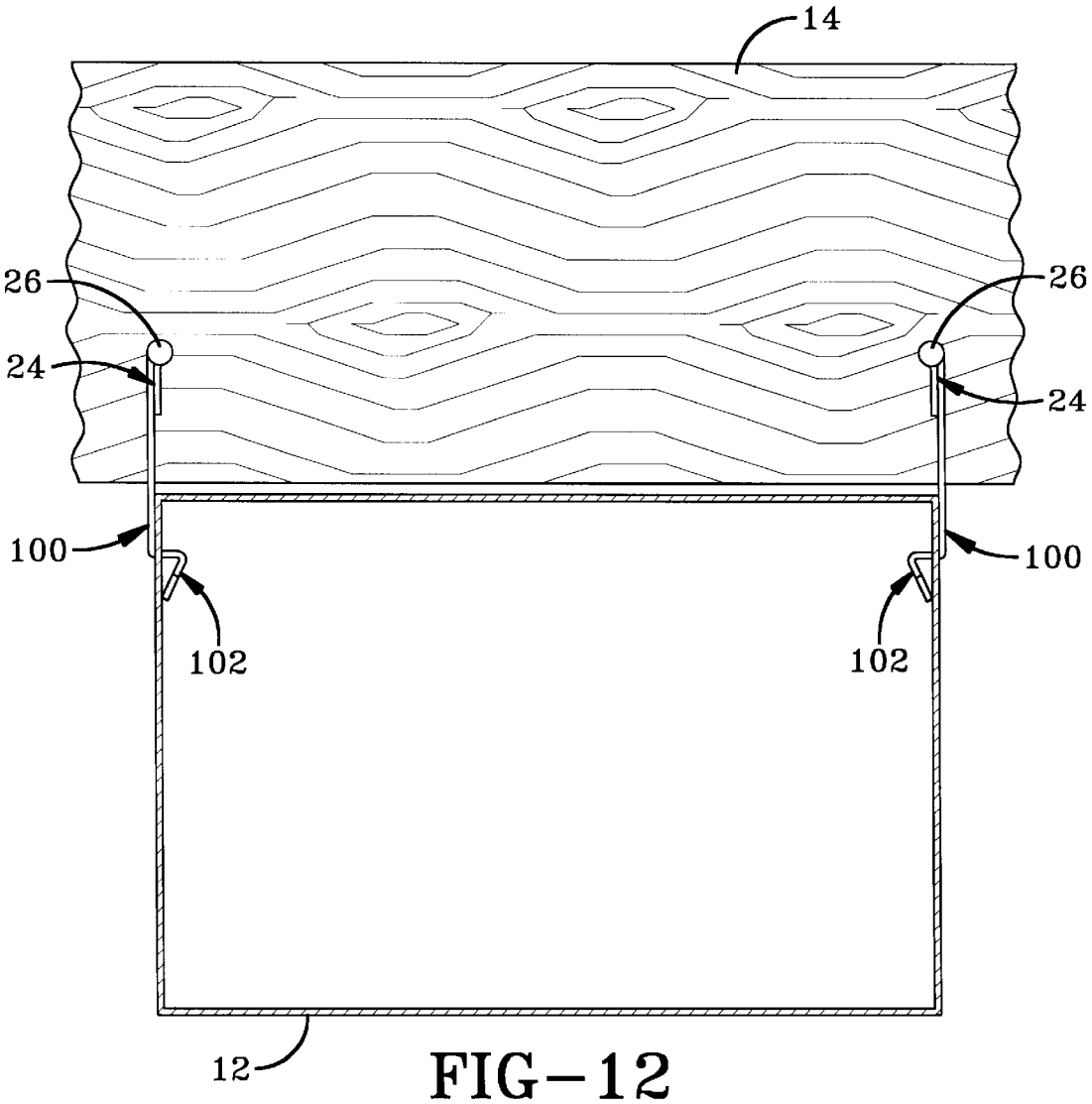
FIG. 12 is a front elevation view partially in section, showing a duct being hung with two of the second embodiment duct hangers.

Each duct hanger 10 includes a body having a main shaft 20, a hook 22 disposed at one end of shaft 20 and a loop 24 disposed at the other end of shafts 20. Hook 22 is configured to interact with duct 12 to support ducts 12. Loop 24 is configured to interact with a connector 26 that mounts hanger 10 to support 14. Shaft 20 defines at least one opening 28 that allows a connector 30 to connect shaft 20 to duct 12 as depicted in FIGS. 5 and 6. Hook 22 defines an opening 32 that allows a connector 34 to connect hook 22 to duct 12 as depicted in FIGS. 5 and 7.

Loop 24 includes a rolled portion 40 and a tongue portion 42. Tongue portion 42 doubles back on shaft 20 and lies closely adjacent or directly against shaft 20. Rolled portion 40 defines an opening 44 that allows connector 26 to pass through loop 24 to hang duct hanger 10 on support 14. Duct hanger 10 is configured to be used with a typical nail having a broad head that may be readily and easily nailed into support 14. In other embodiments, duct hanger 10 may be supported by screws, pins, pegs, hooks, and the like. When connector 26 is used, the head of nail 26 is larger than openings 44 so that duct hanger 10 cannot fall off of connector 26 after connector 26 is embedded within support 14.

Figure 14:
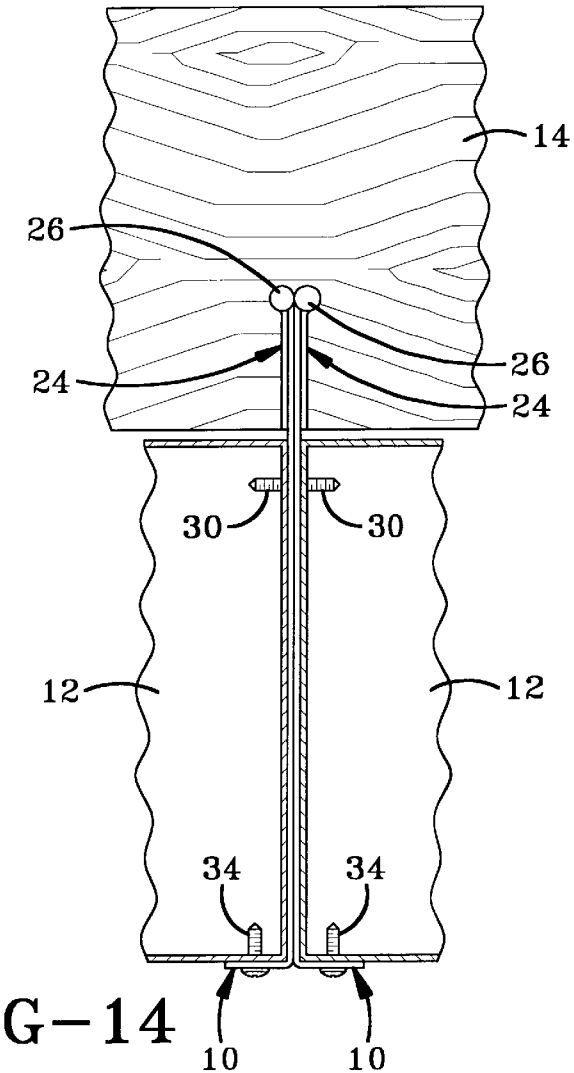
FIG. 14 is a front elevation view showing a pair of the first embodiment duct hangers disposed back to back.

The rear surface of shaft 20 is preferably straight at loop 24 so that pairs of duct brackets 10 may be used back-to-back as shown in FIG. 14. Rolled portion 40 is rolled upwardly away from shaft 20 to permit this configuration.

Figure 3:
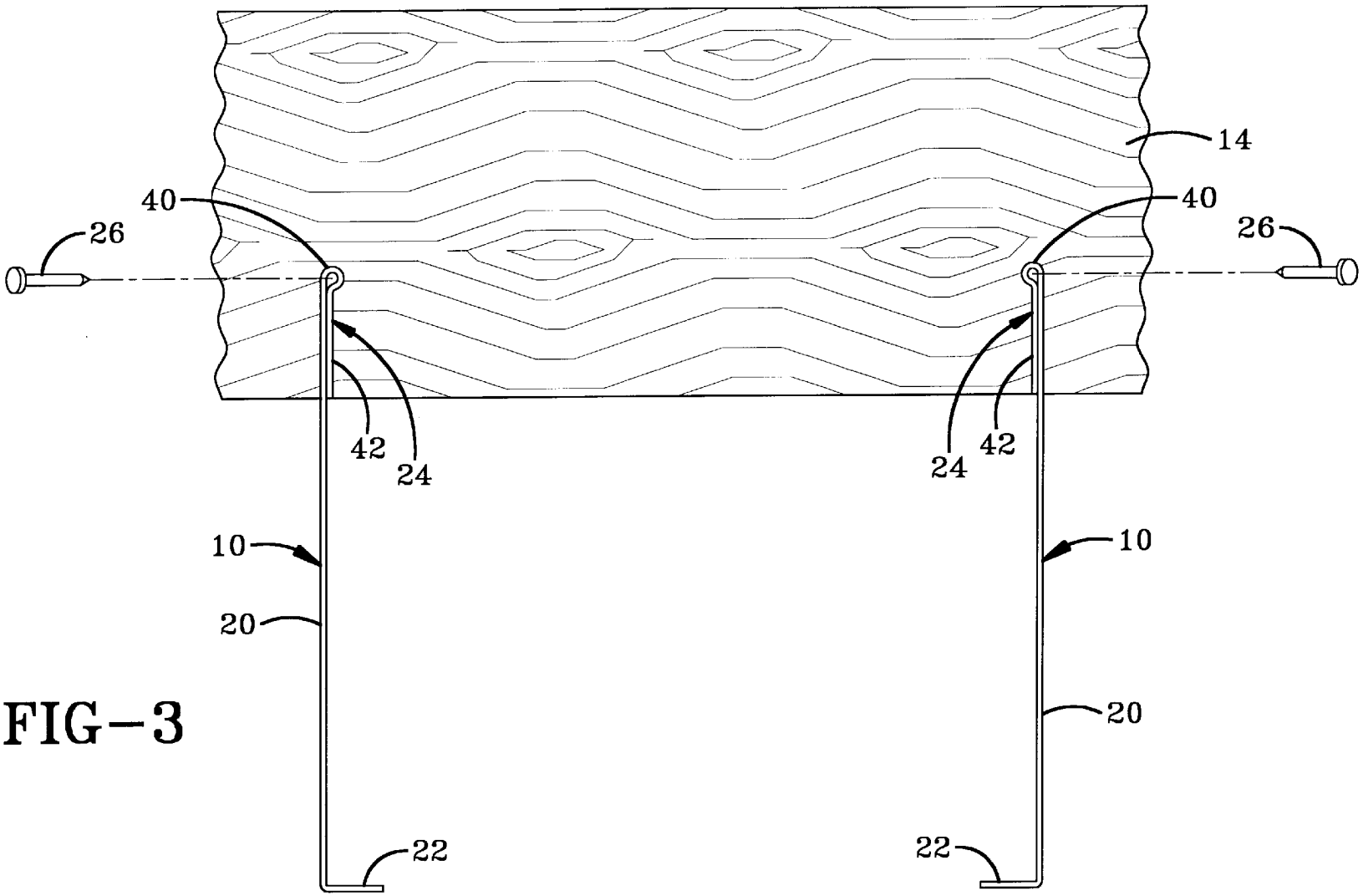
FIG. 3 is a front elevation view showing the duct hangers being installed on a wooden support.
Figure 4:
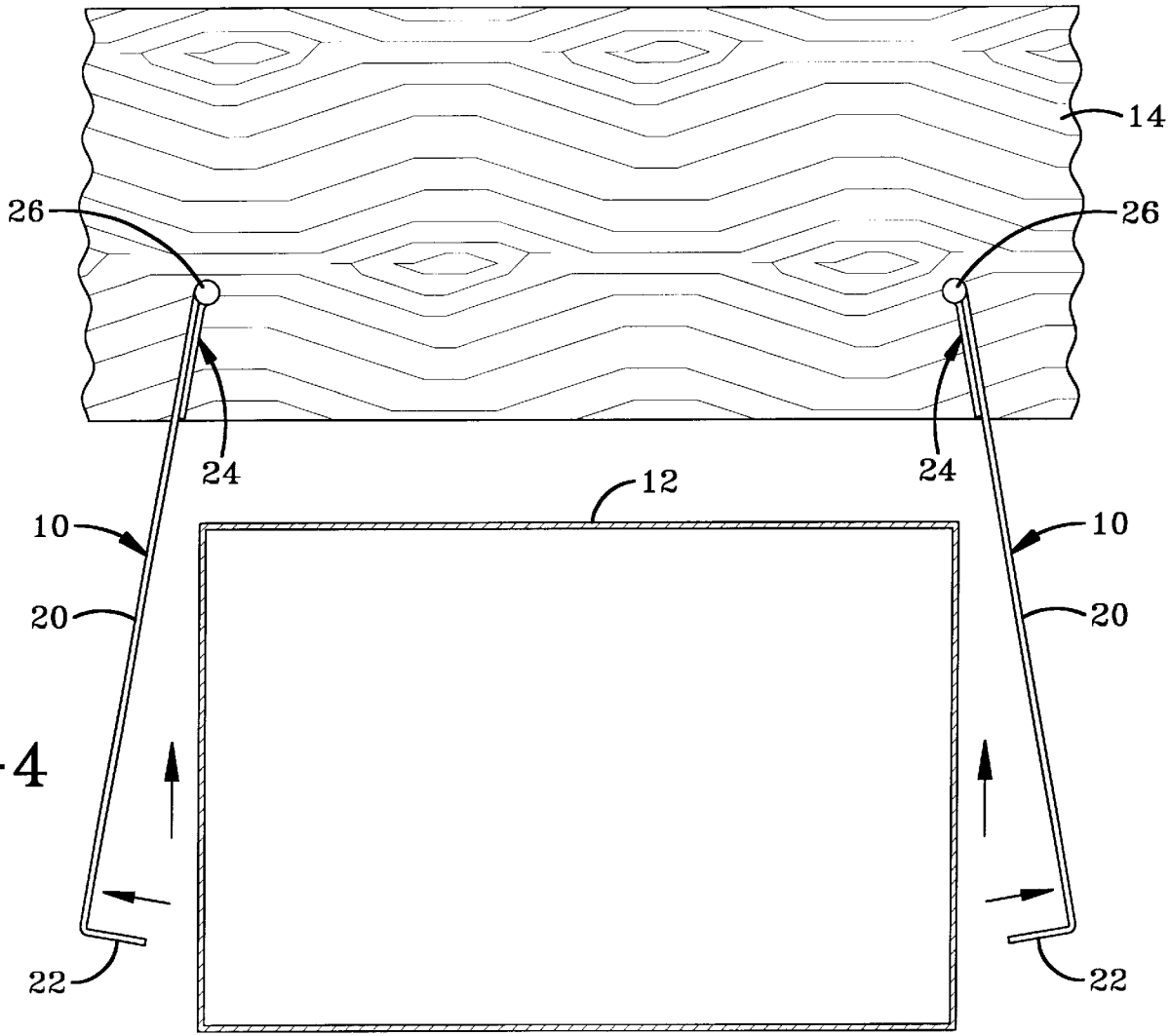
FIG. 4 is a front elevation view showing the duct being positioned between the duct hangers.

Duct brackets 10 may be installed by first connecting brackets 10 to support 14 with connectors 26 as depicted in FIG. 3. In the embodiment of the invention depicted in FIG. 3, tongue portion 42 has a length that aligns the end of tongue portion 42 with the bottom of support 42 when duct bracket 10 is in the proper position with respect to support 14. Tongue portion 42 thus allows the user to install duct bracket 10 without measuring the height dimension for connector 26. After duct brackets 10 are installed as depicted in FIG. 3, duct 12 is brought up between duct brackets 10 as depicted in FIG. 4. Appropriate connectors 30 and 34 may then be used to securely connect duct brackets 10 to duct 12 as depicted in FIG. 5. In an alternative embodiment of the invention, a gasket may be disposed between duct bracket 10 and duct 12 to deaden noise. The gasket may be made from a variety of suitable materials known in the art.

Figure 10:
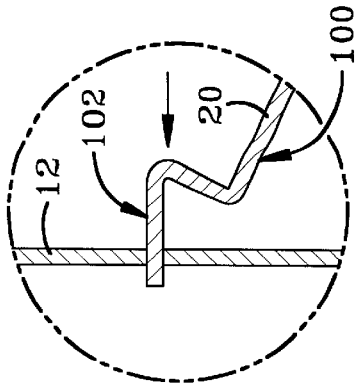
FIG. 10 is an enlarged sectional view of the encircled portion of FIG. 9.
Figure 11:
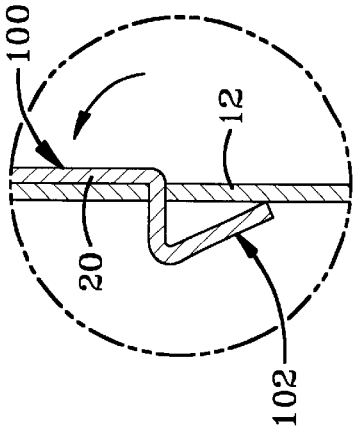
FIG. 11 is a view similar to FIG. 10 showing the duct hanger being rotated to a second position.
Figure 9:
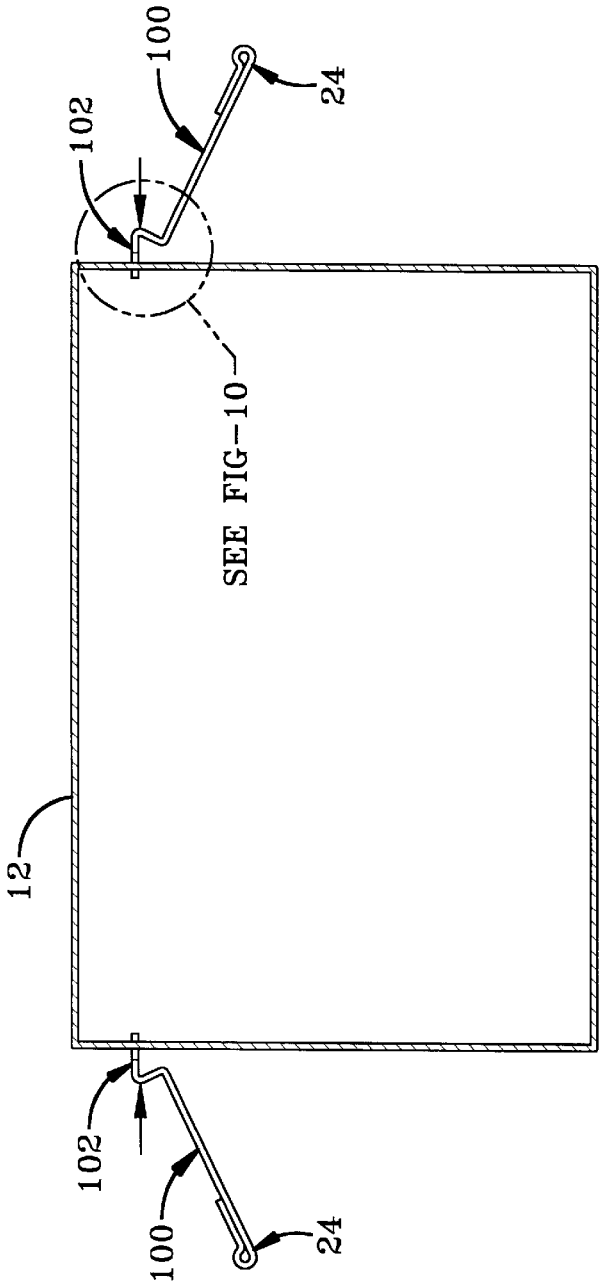
FIG. 9 is a front elevation view showing two of the second embodiment duct hangers being installed in a duct.

The second embodiment of the duct hanger of the present invention is indicated generally by the numeral 100 in FIGS. 8–12. Duct hanger 100 includes loop 24 as described above. Hook 102 of duct hanger 100 is configured to be punched through the sidewall of duct 12 as depicted in FIGS. 9–11. Hook 102 includes a first end connect to the main shaft and a substantially pointed second end. Hook 102 has a first portion that extends substantially perpendicular from the front surface of the main shaft. Hook 102 also includes a second portion that extends downwardly and rearwardly from the first portion.

Figure 13:
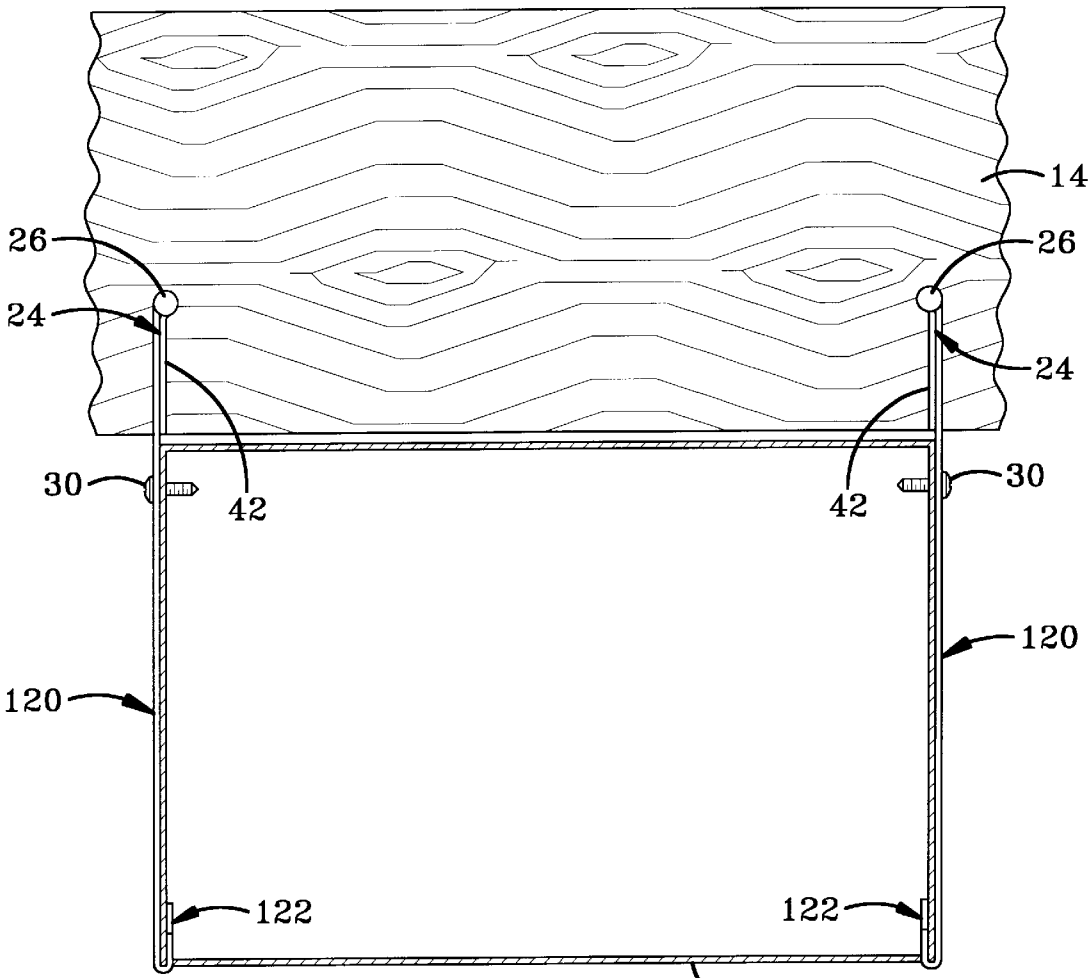
FIG. 13 is a front elevation view of a third embodiment of the duct hanger of the present invention.

FIG. 13 depicts a third embodiment of a duct hanger according to the concepts of the present invention. A third embodiment of the duct hanger is indicated generally by the numeral 120 and includes a hook 122 that punctures the bottom of duct 12. Duct hanger 120 includes loop 24 that functions as described above. Hook 122 is U-shaped with a first U-shaped curved portion and a second portion that is substantially parallel to the main shaft.

In each of the embodiments of the duct hanger described above, the duct hanger may be used on the left or right hand side of duct 12. Duct hangers 10 and 120 may be used with ducts having different heights by altering the location of connector 26 in support 14. Each duct hanger 10, 100, and 120 may be installed in a back-to-back mounting configuration. Each duct hanger does not have to be embedded into support 14. Another advantage is that loop 24 is thin enough and has a profile that allows each duct hanger 10, 100, and 120 to be slid up between adjacent ducts 12 when necessary.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

I claim:

1. A hanger for connecting a duct to a support; the hanger comprising:

a main shaft having first and second opposed ends;

the main shaft having a front surface and a rear surface;

a hook connected to the main shaft adjacent the first end of the shaft; the hook adapted to engage the duct; the hook projecting in a direction outward from the front surface of the main shaft;

a loop connected to the main shaft adjacent the second end of the shaft; the loop adapted to receive a connector; the connector being adapted to engage the support; the loop projecting in a direction outward from the front surface of the main shaft whereby two duct hangers are adapted to be disposed back-to-back with their rear surfaces contacting each other along the length of the main shaft; and the loop including a rolled portion and a tongue portion; the rolled portion defining an opening adapted to receive the connector.

2. The hanger of claim 1, wherein the tongue portion has an end; the end adapted to align with the support to properly position the hanger with respect to the support.

3. A hanger for connecting a duct to a support; the hanger comprising:

a main shaft having first and second opposed ends;

the main shaft having a front surface and a rear surface;

a hook connected to the main shaft adjacent the first end of the shaft; the hook adapted to engage the duct; the hook projecting in a direction outward from the front surface of the main shaft;

a loop connected to the main shaft adjacent the second end of the shaft; the loop adapted to receive a connector; the connector being adapted to engage the support; the loop projecting in a direction outward from the front surface of the main shaft whereby two duct hangers are adapted to be disposed back-to-back with their rear surfaces contacting each other along the length of the main shaft;

the hook projecting substantially perpendicular with respect to the main shaft; and the hook defining an opening adapted to receive a connector.

4. A hanger for connecting a duct to a support; the hanger comprising:

a main shaft having first and second opposed ends;

the main shaft having a front surface and a rear surface;

a hook connected to the main shaft adjacent the first end of the shaft; the hook adapted to engage the duct; the hook projecting in a direction outward from the front surface of the main shaft;

a loop connected to the main shaft adjacent the second end of the shaft; the loop adapted to receive a connector; the connector being adapted to engage the support; the loop projecting in a direction outward from the front surface of the main shaft whereby two duct hangers are adapted to be disposed back-to-back with their rear surfaces contacting each other along the length of the main shaft; and the shaft defining an opening intermediate the hook and the loop; the opening adapted to receive a connector.

5. A hanger for connecting a duct to a support; the hanger comprising:

a main shaft having first and second opposed ends;

a hook connected to the main shaft adjacent the first end of the shaft; the hook adapted to engage the duct;

a loop connected to the main shaft adjacent the second end of the shaft; the loop adapted to receive a connector; the connector being adapted to engage the support; the hook being adapted to pierce the duct; and the hook including a first portion and a second portion; the first portion extending substantially perpendicular from the main shaft; the second portion projecting at an angle from the first portion; the second portion being pointed.

6. The hanger of claim 5, wherein the main shaft has a front surface and a rear surface; the hook projecting in a direction outward from the front surface of the shaft; the front surface of the shaft adapted to face the duct.

7. The hanger of claim 6, wherein the loop has a rear surface that is coplanar with the rear surface of the main shaft such that no portion of the loop projects out from the rear surface of the shaft whereby two duct hangers may be disposed back-to-back with their rear surfaces contacting each other along the length of the main shaft.

8. A hanger for connecting a duct to a support; the hanger comprising:

a main shaft having first and second opposed ends;

the main shaft having a front surface and a rear surface;

a hook connected to the main shaft adjacent the first end of the shaft; the hook adapted to engage the duct; the hook projecting in a direction outward from the front surface of the main shaft;

a loop connected to the main shaft adjacent the second end of the shaft; the loop adapted to receive a connector; the connector being adapted to engage the support; the loop projecting in a direction outward from the front surface of the main shaft whereby two duct hangers are adapted to be disposed back-to-back with their rear surfaces contacting each other along the length of the main shaft;

the hook being adapted to pierce the duct; and the hook including a first portion and a second portion; the first portion being U-shaped; the second portion being substantially parallel with the main shaft.

9. A hanger for connecting a duct to a support; the hanger comprising:

a main shaft having first and second opposed ends;

the main shaft having a front surface and a rear surface;

a hook connected to the main shaft adjacent the first end of the shaft; the hook adapted to engage the duct; the hook projecting in a direction outward from the front surface of the main shaft;

a loop connected to the main shaft adjacent the second end of the shaft; the loop adapted to receive a connector; the connector being adapted to engage the support; the loop projecting in a direction outward from the front surface of the main shaft whereby two duct hangers are adapted to be disposed back-to-back with their rear surfaces contacting each other along the length of the main shaft; and the hook including a first portion and a second portion; the first portion being U-shaped; the second portion being substantially parallel with the main shaft.

10. A duct and a hanger for supporting the duct from a support; the combination comprising:

a support having a lower surface;

a duct having a lower surface;

a connector;

a hanger connected to the support with the connector;

the hanger comprising a main shaft, a hook, and a loop;

the main shaft having first and second opposed ends;

the main shaft having a front surface and a rear surface;

the hook being connected to the main shaft at the first end of the shaft;

the hook disposed under the lower surface of the duct;

the loop connected to the second end of the main shaft; and the loop including a rolled portion and a tongue portion; the rolled portion defining an opening that receives the connector; the tongue portion having an end; the end aligned with the lower surface of the support to properly position the hook with respect to the support and the lower surface of the duct.

11. The hanger of claim 10, wherein the hook defines an opening and wherein the main shaft defines an opening; the openings adapted to receive connectors.

12. A hanger for connecting a duct to a support; the hanger comprising:

a main shaft having first and second opposed ends;

the main shaft having a front surface and a rear surface;

a hook connected to the main shaft adjacent the first end of the shaft; the hook being pointed and adapted to pierce the duct; the hook projecting in a direction outward from the front surface of the main shaft;

a loop connected to the main shaft adjacent the second end of the shaft; the loop having a rear surface; the loop projecting in a direction outward from the front surface of the shaft whereby two duct hangers are adapted to be disposed back-to-back with their rear surfaces contacting each other along the length of the main shaft; and the rear surface of the loop being substantially coplanar with the rear surface of the main shaft.

13. The hanger of claim 12, wherein the loop includes a rolled portion and a tongue portion; the rolled portion defining an opening adapted to receive a connector; the tongue portion having an end; the end adapted to align with the support to properly position the hanger with respect to the support.

14. The hanger of claim 12, wherein the main shaft defines an opening; the opening being adapted to receive a connector.

15. The hanger of claim 12, wherein the loop that receives the connector defines an opening having a longitudinal axis; the longitudinal axis being parallel to the front and rear surfaces of the main shaft.

* * * * *